US005353678A

United States Patent [19]

Rochelle et al.

[11] Patent Number: 5,353,678

[45] Date of Patent: Oct. 11, 1994

[54] AUTOMATIC GUN WITH A SWINGING CHAMBER FOR FIRING TELESCOPED CYLINDRICAL ROUNDS

[75] Inventors: Marc Rochelle; Jean-François Lescure; Julien Jimenez, all of Bourges, France

[73] Assignee: Giat Industries, Versailles, France

[21] Appl. No.: 64,960

[22] Filed: May 20, 1993

[30] Foreign Application Priority Data

May 22, 1992 [FR] France ..... 92 06278

[51] Int. Cl.[5] ..... F41A 9/45; F41A 9/50; F41A 15/00

[52] U.S. Cl. ..... 89/9; 89/33.03; 89/33.05; 89/42.03

[58] Field of Search ..... 42/39.5; 89/9, 13.05, 89/33.03, 33.05, 42.03, 155, 156

[56] References Cited

U.S. PATENT DOCUMENTS

| | | | |
|---|---|---|---|
| 3,318,191 | 5/1967 | Reed | 89/42.03 |
| 3,760,683 | 9/1973 | Seemann | 89/12 |
| 4,357,857 | 11/1982 | Magnuson | 89/156 |
| 4,697,496 | 10/1987 | Goldin | 89/33.03 |

FOREIGN PATENT DOCUMENTS

| | | | |
|---|---|---|---|
| 64661 | 11/1982 | European Pat. Off. | 89/9 |

*Primary Examiner*—Stephen C. Bentley
*Attorney, Agent, or Firm*—Bell, Seltzer, Park & Gibson

[57] ABSTRACT

An automatic gun for firing telescoped cylindrical ammunition, the gun comprising a sleeve for supporting a barrel, a breech, and a rear box which are all rigidly connected together by beams, the gun including a chamber disposed between the breech and the barrel and mounted to swing by pivoting about an eccentric shaft, and further including means carried by the breech and the rear box to feed ammunition to the chamber.

13 Claims, 8 Drawing Sheets

AUTOMATIC GUN WITH A SWINGING CHAMBER FOR FIRING TELESCOPED CYLINDRICAL ROUNDS

FIELD OF THE INVENTION

The invention relates to an automatic gun with a swinging chamber for firing telescoped cylindrical rounds, such as a medium caliber cannon, for example.

BACKGROUND OF THE INVENTION

Telescoped cylindrical ammunition has been known since the early 1970s and, compared with conventional ammunition, it has the advantage of being lighter and more compact, with the projectile being entirely received inside a cylindrical case of constant section, thereby making it possible to load a round of such ammunition axially to one end of the chamber of the gun and to extract the empty case axially through the other end of the chamber, thereby simplifying the mechanisms for extracting empty cases.

U.S. Pat. No. 4,357,857 describes an automatic gun for firing telescoped cylindrical rounds, in which a chamber disposed between the breech and the barrel of the gun is mounted to swing about an axis that is parallel to the axis of the barrel between a firing position in which the chamber is in coaxial alignment with the barrel, and a loading position in which it is angularly offset from the breech and the barrel for the purposes of receiving a new round and of enabling the empty case of the previously fired round to be ejected.

In that known gun, the recoil motion that results from firing a round is used for obtaining the angular displacement of the chamber between its firing and loading positions, and for loading a new round into the chamber and for ejecting the empty case of the previously fired round. The operation of the gun therefore depends on the operation of the rounds, and gives rise to accelerations and shocks which are considerable, and which put a severe stress on the mechanisms. In addition, in that gun, nearly all of the movements required for loading a round are performed by the chamber which is a very heavy component whose displacement consumes a large amount of energy and gives rise to violent shocks. Furthermore, a round loaded into the chamber can be fired only when the recoil portions of the gun have been returned to the battery position, thereby limiting the firing rate.

OBJECTS AND BRIEF SUMMARY OF THE INVENTION

An object of the invention is to provide an automatic gun with a swinging chamber for firing telescoped cylindrical rounds, and not subject to the above drawbacks.

Another object is to provide an automatic gun of the above-specified type that makes floating firing possible, in other words a round loaded into the chamber can be fired before the recoil portion of the gun has returned to the battery position, thereby increasing the firing rate.

Another object is to provide a gun of the above-specified type whose operation is independent of the operation of the rounds.

To this end, the present invention provides an automatic gun having a swinging chamber for firing telescoped cylindrical ammunition, such as a medium caliber cannon, for example, the gun comprising a round-receiving chamber disposed between a breech and a barrel and mounted to swing between a loading position and a firing position by pivoting about an eccentric shaft parallel with the barrel, means for displacing the chamber between said two positions, and means for feeding ammunition to the chamber, wherein the breech, the barrel, and the chamber pivot shaft are carried in stationary manner by a rigid structure that also carries ammunition feed means and electric motor means for driving means for displacing the chamber and the ammunition feed means, the ammunition feed means being disposed behind the chamber and being in axial alignment therewith when the chamber is in its loading position, and comprising means for displacing a round of ammunition in axial translation between a feed position and the chamber while the chamber is in its loading position, insertion of a round via the rear end of the chamber causing an empty case of a previously fired round to be extracted via the front end of said chamber.

Thus, according to the invention, the operation of the gun is provided by an electric motor, thereby making it possible to obtain operating cycles that are more regular and that are independent from the operation of the rounds. Furthermore, the controlled displacements of the chamber are limited to a reciprocating angular displacement between its firing position and its loading position, feed means driven by the electric motor being provided to displace the rounds axially and insert them one by one into the chamber. As a result, the inertia of the parts of the gun whose movements are controlled by the electric motor is greatly reduced, thereby making it possible to increase the firing rate.

According to another feature of the invention, the pivot shaft of the chamber is rotated about its own axis by the electric motor means and is connected to the chamber by transmission means transforming the rotary motion of the shaft into reciprocating oscillation of the chamber between its loading position and its firing position.

In a particular embodiment of the invention, the transmission means comprise firstly a carriage guided in translation on said rigid structure parallel to the pivot shaft of the chamber and displaced in rectilinear reciprocating motion by said shaft by means of a wheel carried by the carriage and engaged in a helical groove on the shaft, and secondly a wheel secured to the chamber and engaged in a sloping groove of said carriage.

These means for displacing the chamber make it possible to control acceleration of the chamber while it is moving, and thus make it possible to reduce shocks at the end of motion.

According to another feature the invention, the chamber includes circular collars at each of its axial ends and designed to engage, when the chamber is brought into its firing position, into corresponding grooves in the breech and in a sleeve for supporting the barrel.

These circular collars engaged in the corresponding grooves of the breech and of the barrel support sleeve then provide the links between the chamber in the firing position and both the breech and the barrel, thereby considerably reducing the weight of the gun by omitting the breech box that is generally provided in a conventional type of gun.

According to yet another feature of the invention, the means for feeding the chamber with ammunition comprise a feed carriage guided in translation on said rigid structure and displaceable in rectilinear reciprocating motion to drive a round from a feed position situated behind the chamber when in its loading position and to insert the round in the chamber by axial translation, said carriage including a wheel engaged in a helical groove of a longitudinal screw rotated by said electric motor means.

This makes it possible, in particular, to control the acceleration of a round throughout its displacement while being inserted into the chamber, in particular by reducing accelerations at the end of displacement, thereby facilitating the loading of rounds and making loading more regular.

According to yet another feature of the invention, the means for feeding ammunition also comprise a feed star carrying a certain number of rounds and mounted to rotate about a longitudinal axis on said rigid structure, behind the chamber so as to bring rounds successively into position on the axis of the chamber when the chamber is in its loading position.

Since the breech and the barrel, the swinging chamber, and the ammunition feed means are all mounted on the same rigid structure that forms a part of the recoil components, the gun makes floating fire possible in high-rate bursts, with a round being fired before the recoil components have returned to the battery position.

BRIEF DESCRIPTION OF THE DRAWINGS

The invention will be better understood and other features, details and advantages thereof will appear more clearly on reading the following description which is made by way of example and given with reference to the accompanying drawings, in which.

MORE DETAILED DESCRIPTION

Figure 1:
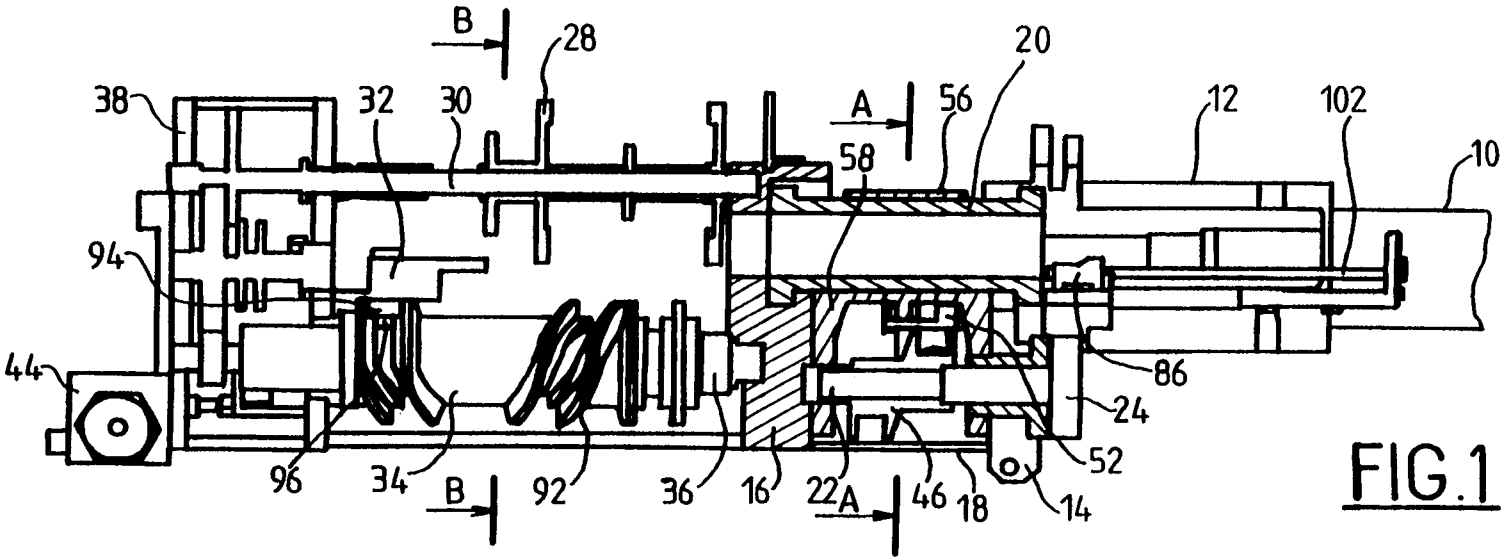
FIGS. 1 and 2 are diagrammatic fragmentary longitudinal section views through a gun of the invention, FIG. 1 showing the swinging chamber in its loading position and FIG. 2 showing it in its firing position.
Figure 2:
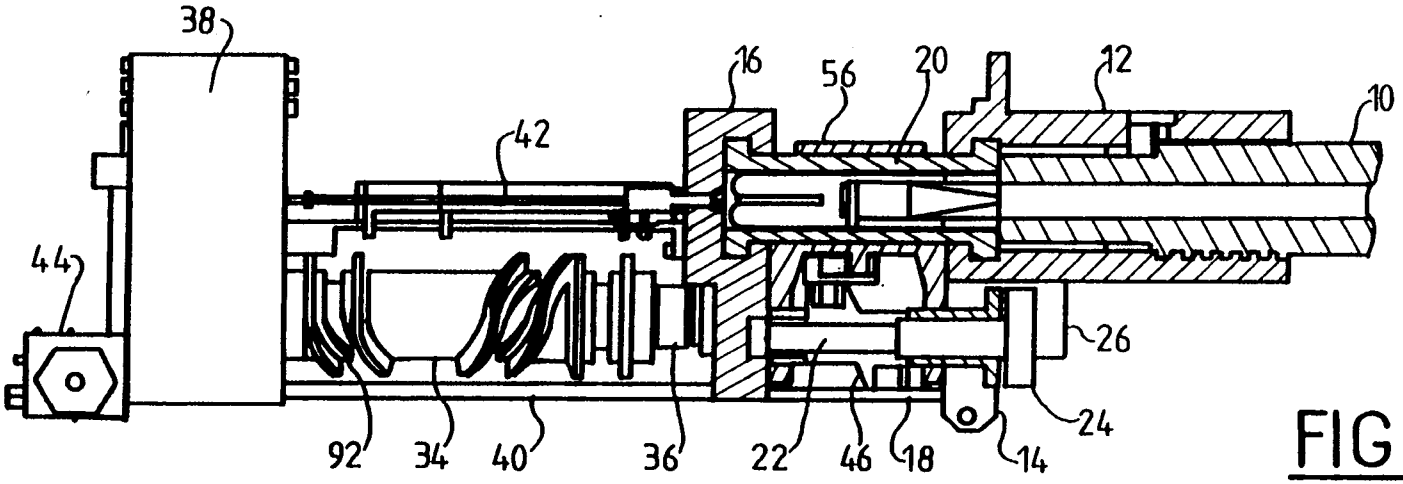

Reference is made initially to FIGS. 1 and 2 which are diagrams showing the essential means of a gun of the invention.

The rear end of the gun barrel 10 is secured in a sleeve 12 carried by a support 14 which is rigidly connected to the breech 16 by a bottom beam 18 and by longitudinal slideways for a carriage that causes the swinging chamber to pivot, as described below.

The swinging chamber 20 disposed between the breech 16 and the rear end of the barrel 10 is a cylindrical component having an axial bore whose diameter and length are very slightly greater than the diameter and the length of a round to be fired. It swings about the axis of a longitudinal shaft 22 extending parallel to the barrel 10 and supported at its ends by the breech 16 and by the sleeve support 14. The front end of the shaft 22 carries a rotary drive gear wheel 24 which is in turn connected via a gear train to the outlet shaft of an electric motor 26 disposed beneath the barrel 10 and the sleeve 12.

At the rear of the breech 16 there are ammunition feed means essentially comprising a feed star 28 carried by a rotary shaft 30 extending parallel to the barrel 10, and a feed carriage 32 displaceable in reciprocating rectilinear motion parallel to the barrel 10 by a feed screw 34 whose front end carries a gear wheel 36 which is connected to the outlet shaft of the motor 26 by a gear train.

The shaft 30 of the feed star 28 and the shaft of the feed screw 34 are carried at their respective ends by the breech 16 and by a rear transmission and control box 38 which is rigidly connected to the breech 16 by a longitudinal bottom beam 40 and by longitudinal slideways for guiding the feed carriage 32 in a manner described below.

A striker system 42 extends between the rear box 38 and the breech 16 on the axis of the barrel 10 and axially displacement thereof is controlled by the rear box 38. The rear box also carries an electromagnet 44 for controlling the trigger.

Figure 3:
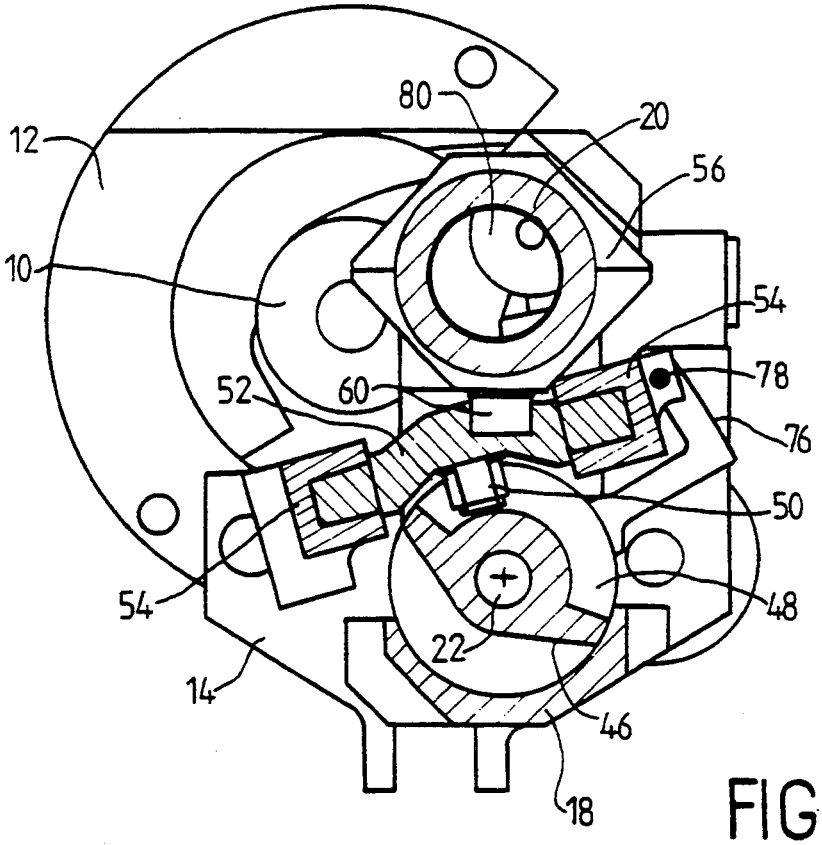
FIG. 3 is a diagrammatic view on a larger scale and in cross-section on line A—A of FIG. 1, showing the chamber in its loading position.

The characteristics of the swinging chamber 20, of its displacement means, and of the feed means are described in greater detail below with reference to FIGS. 3 et seq. Nevertheless, it can already been seen that the sleeve 12 for fixing the barrel 10, the breech 16, and the rear box 38 all form parts of a common rigid structure which carries the swinging chamber 20 and its displacement means, together with the ammunition feed means, the electric motor 26, and the associated sets of gears. The entire assembly is subjected to recoil motion when a round is fired, followed by return motion to the battery position.

There follows a more detailed description of the structure of the swinging chamber 20 and of its displacement means, with reference to FIGS. 3 to 7.

The longitudinal shaft 22 mounted between the breech 16 and the sleeve support 14 supports a screw 46 having a helical groove 48 that receives the bottom wheel 50 of a carriage 52 which is guided in displacement in longitudinal slideways 54 that rigidly connect together the sleeve support 14 and the breech 16. The carriage 52 and its guiding slideways 54 are disposed between the shaft 22 and the swinging chamber 20. The chamber is substantially cylindrical in shape and it is fixed in a piece 56 having two parallel arms 58 at its axial ends for providing a swinging mount on the ends of the shaft 22. The bottom face of the piece 56 carries a wheel 60 which is received in a sloping groove 62 in the top face of the carriage 52, with the ends 64 and 66 of the groove respectively defining the loading position and the firing position of the swinging chamber 20.

Figure 4:
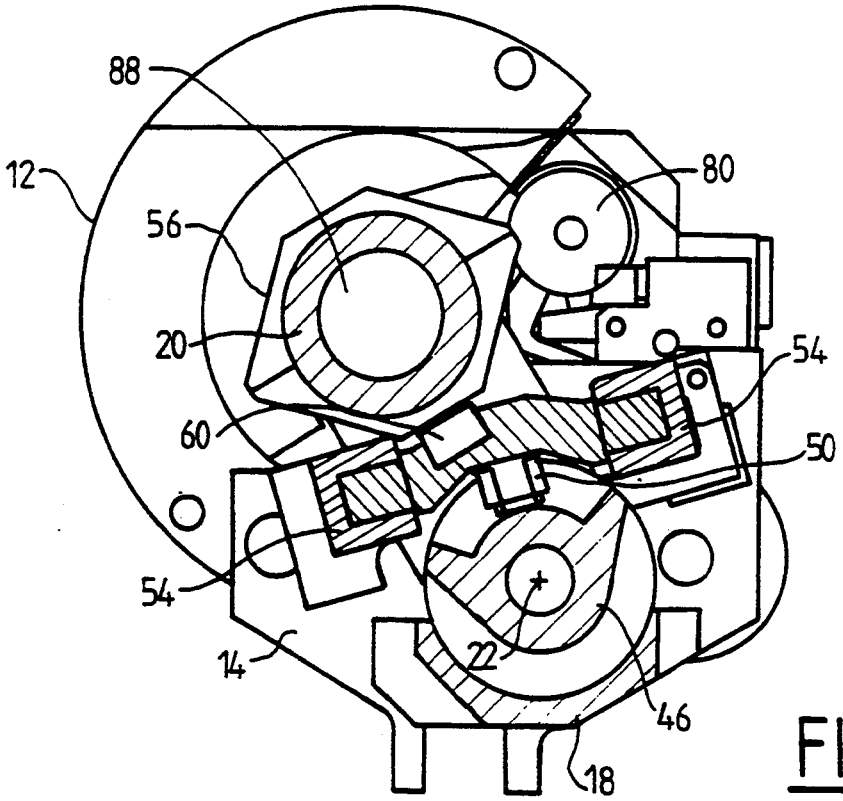
FIG. 4 is a view similar to FIG. 3, but showing the chamber in its firing position.
Figure 5:
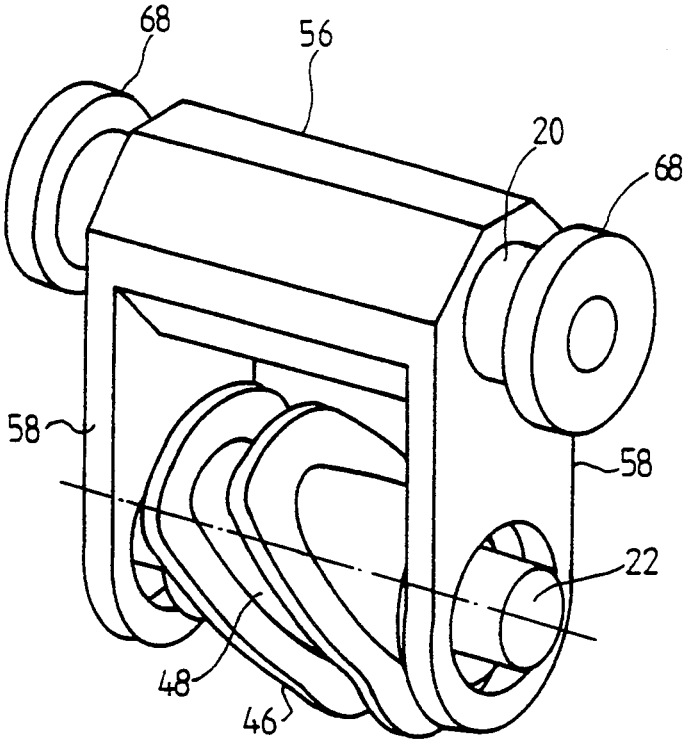
FIG. 5 is a diagrammatic perspective view of the chamber, of its support, and of its pivoting screw.
Figure 6:
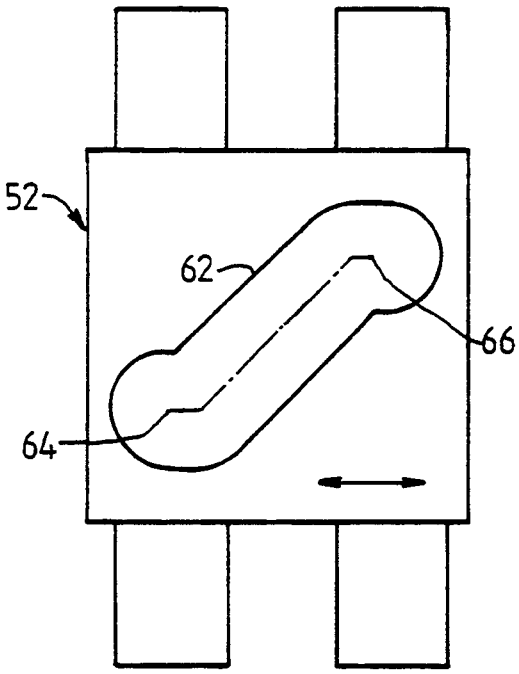
FIGS. 6 and 7 are a diagrammatic plan view and side view of the carriage for displacing the chamber.
Figure 7:
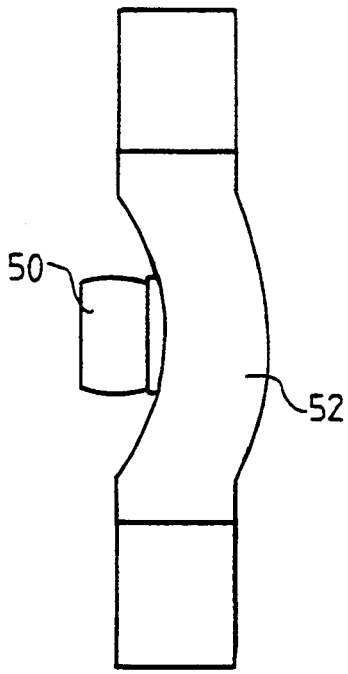

The shaft 22 performs one full revolution per operating cycle of the gun. It rotates the screw 46 which, via the bottom wheel 50 of the carriage 52, transforms the rotation of the shaft 22 into rectilinear go-and-return displacement of the carriage 52 in its guiding slideways 54. This rectilinear displacement of the carriage 52 is transformed, by means of the wheel 60 engaged in the sloping groove 62, into oscillating go-and-return motion of the chamber 20 between its loading position as shown in FIG. 3 and its firing position as shown in FIG. 4. More precisely, when the carriage 52 is in its front extreme position, the wheel 60 of the piece 56 is at the rear end 64 of the groove 62 and the chamber 20 is in its loading position, whereas when the carriage 52 is in its rear extreme position, the wheel 60 of the piece 56 is at the front end 66 of the groove 62 and the chamber 20 is in its firing position.

Figure 9:
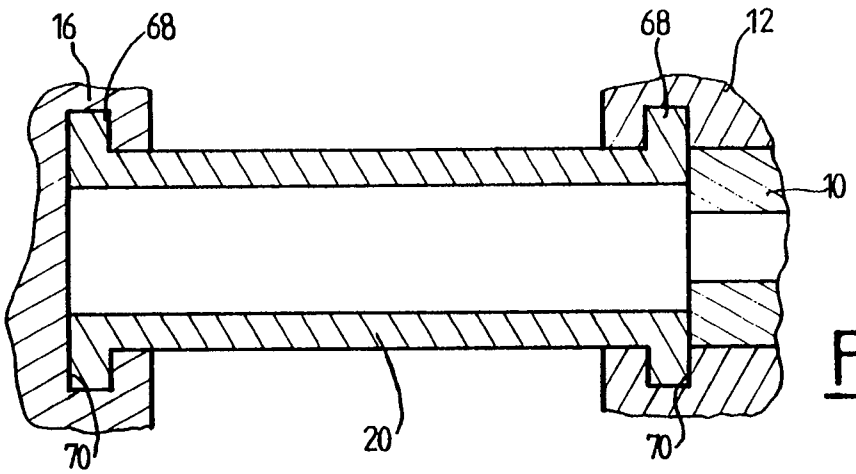
FIG. 9 is a diagrammatic fragmentary axial section showing how the chamber is secured to the breech and to the barrel support sleeve.
Figure 8:
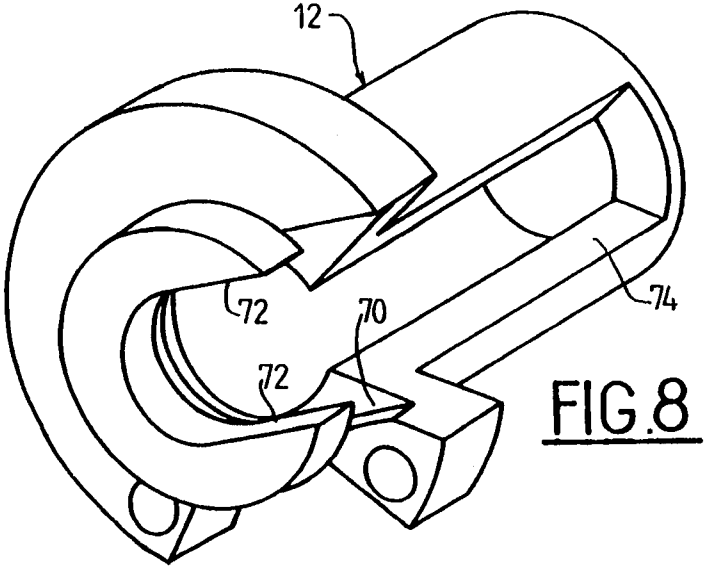
FIG. 8 is a diagrammatic perspective view on a larger scale of the barrel support sleeve of the gun.

At its axial ends, the chamber 20 includes two circular collars 68 (FIG. 5) for engaging in complementary-shaped grooves 70 machined at the ends of the sleeve 12 and of the breech 16 (FIGS. 8 and 9). As can be seen in FIG. 8, which is a perspective view of the sleeve 12, each groove 70 extends angularly over 180° and is extended at its ends by two parallel guide ramps 72 between which the corresponding axial end of the chamber 20 is engaged when the chamber is in its firing position.

In the firing position of the chamber 20, the circular collars 68 engaged in the grooves 70 of the sleeve 12 and of the breech 16 provide connection between the breech, the chamber, and the sleeve while a round is being fired, without there being any need to provide a breech box as in a conventional type of gun. Under such conditions, it is the chamber 20 which is subject to the traction forces while a round is being fired.

As can also be seen in FIG. 8, the sleeve 20 includes a longitudinal groove 74 which is formed throughout the thickness of its cylindrical wall and which extends from the rear end of the sleeve to the vicinity of its front end, in order to enable an empty cartridge case to be extracted through the front of the chamber 20 while the chamber is in its loading position. Under such conditions, the angular displacement of the chamber 20 between its firing position and its loading position is no greater than that required to ensure that the bore of the chamber is entirely disengaged from the rear end of the barrel 10, thereby making it possible to limit the angular displacement of the chamber 20 to about 30°, and thus making it possible to accelerate the firing rate.

Figure 11:
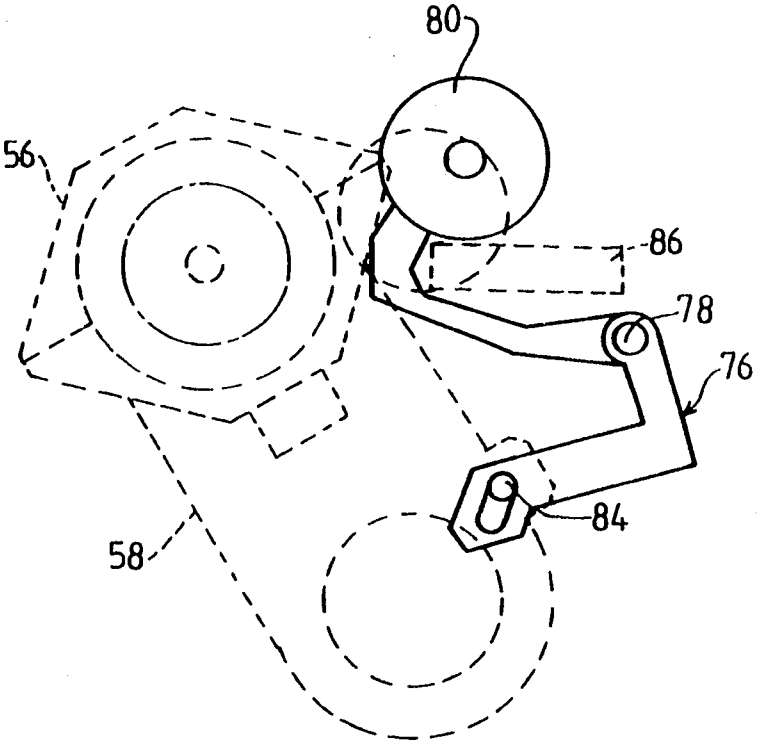
FIGS. 10 and 11 are diagrams showing the empty case ejector arm and how it operates.
Figure 10:
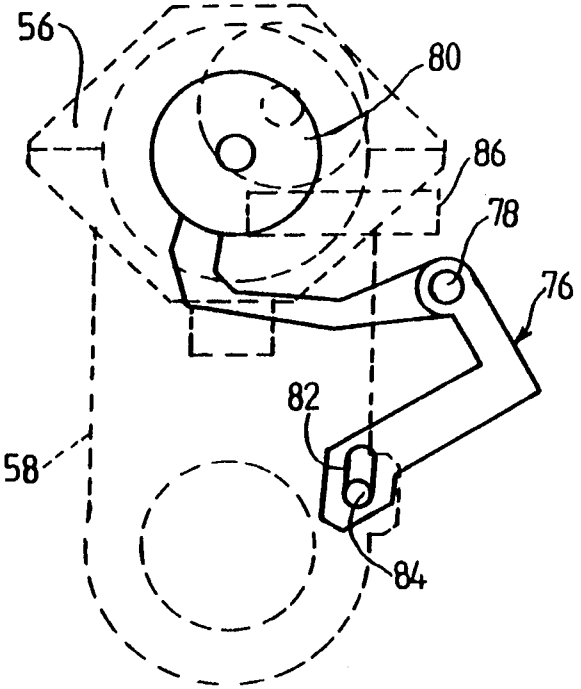

Furthermore, as shown diagramatically in FIGS. 10 and 11, an ejector arm 76 is provided to displace an empty case from an extraction position where it is partially engaged in the groove 74 of the sleeve 12, to an ejection position where it is disengaged from said groove and is in alignment with an ejection chute (not shown).

The middle portion of the ejector arm 76 is pivotally mounted about a longitudinal axis 78 on the sleeve support 14, its top end being designed to press against the underside of an empty case 80 extracted from the chamber, while its bottom end includes a slot 82 that receives a finger 84 carried by one of the arms 58 of the piece 56 for supporting the chamber 20. In the position of FIG. 10, the chamber 20 is in its loading position, the top end of the arm 76 bears against the underside of an empty case 80 extracted from the chamber and having its front end bearing against a retaining carriage 86 that is displaceable in reciprocating rectilinear motion in a manner described below, the empty case 80 also being supported in this position by the longitudinal groove 74 of the sleeve 12. When the swinging chamber is brought into its firing position as shown in FIG. 11, pivoting of the arm 58 gives rise to rotation of the ejector arm 76 about the axis 78 in a clockwise direction so as to bring the case 80 into an ejection position.

In this ejection position, the empty case 80 has been disengaged at its front end from the retaining carriage 86 and it can therefore be displaced rearwards as also described below.

Figure 12:
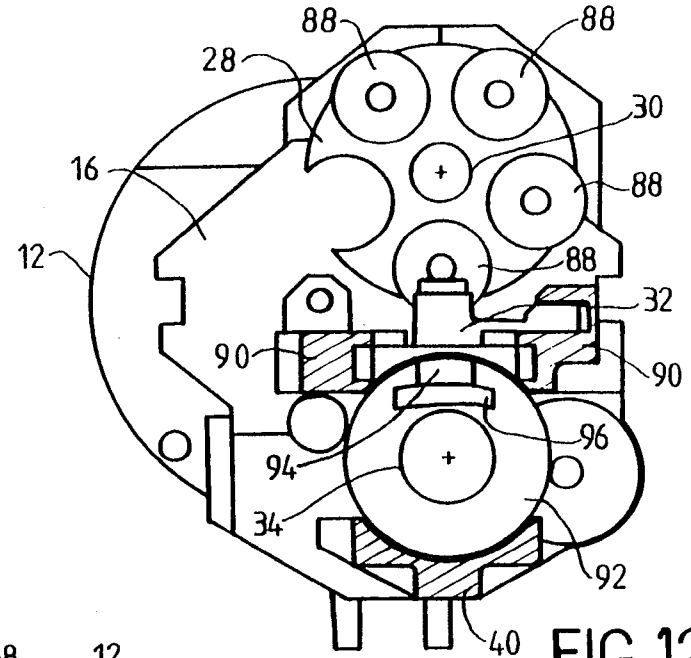
FIG. 12 is a diagrammatic view on a larger scale and in cross-section on line B—B of FIG. 1.

Reference is now made to FIGS. 12 et seq. for describing the ammunition feed means and the operation thereof.

In the example of FIG. 12, the feed star 28 mounted on the longitudinal shaft 30 may carry four telescoped cylindrical rounds 88 which are brought successively by successive rotations of the star 28 through one-fifth of a revolution into a bottom position level with the feed carriage 32 and in axial alignment with the chamber 20 when brought into its loading position.

The feed carriage 32 is guided in rectilinear displacement by two longitudinal slideways 90 which rigidly connect the rear box 38 to the breech 16, the carriage 32 thus being disposed between the feed star 28 and the feed screw 34.

The feed screw includes a stepped helical groove 92 (FIGS. 1 and 2) receiving a vertically superposed wheel 94 and sliding skid 96 which are fixed beneath the carriage 32. The wheel 94 is engaged in the wider portion of the groove 92 while the skid 96 is engaged in the narrower portion and contributes to passing the wheel through the intersections of the groove 92 of the screw while the screw is rotating, said groove 92 having crossed threads so as to make it possible for the carriage 32 to move back and forth while the screw 34 rotates continuously in a given direction. The screw 34 is rotated at three times the speed of the shaft 22 for displacing the swinging chamber 20.

When the carriage 32 is in its rear position and it begins to move forwards, it bears against the rear end of a round 88 in the feed star 28 and it pushes the round forwards to insert it into the chamber 20 which is then in its loading position.

The feed carriage 32 is connected to the retaining carriage 86 described with reference to FIGS. 10 and 11 by means of a rigid rod 98 and of a latch support 100 (FIGS. 13 et seq.), the retaining carriage 86 being itself guided in translation on two parallel longitudinal rods 102 which are fixed at their respective ends to the sleeve 12 and to the sleeve support 14 (FIG. 1).

The carriage 32 includes a lateral tab 104 engaged in an elongate slot in the latch support 100 and enabling limited longitudinal displacement of the carriage 32 relative to the latch support 100. A latch 106, such as a roller or a ball, is engaged in a small transversal groove of the support 100 and in a longitudinal groove 108 of the rigid structure, with latching pegs 110 being provided at the ends thereof and being urged by springs to engage in a notch 112 of the latch support to hold it in position. In addition, the tab 104 of the carriage 32 includes two parallel grooves 114 in each of which the latch 106 can engage in part so as to secure the carriage 32 to the latch support 100.

The operation of these ammunition feed means is described below with reference to FIGS. 13 et seq.

Figure 13:
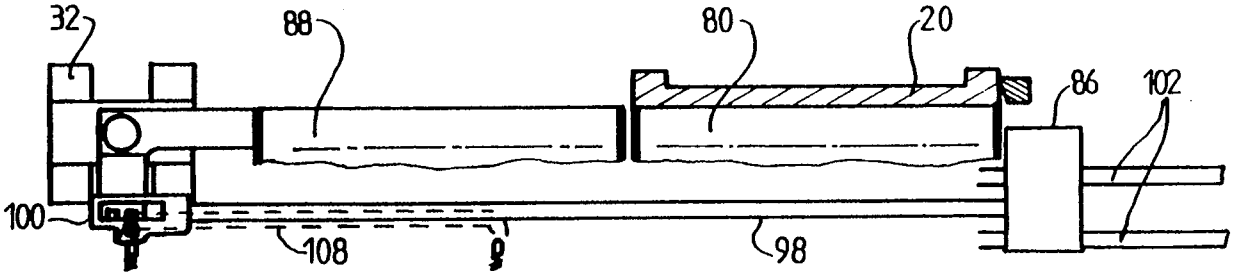

In FIG. 13, the chamber 20 is in its loading position, in axial alignment with the carriage 32, and with a round 88 carried by the star 28. The chamber 20 contains an empty case 80 of a round that has just been fired, the retaining carriage 86 is a few millimeters ahead of the front face of the chamber 20, and the feed carriage 32 is a few millimeters behind the round 88 to be loaded into the chamber 20.

Figure 14:
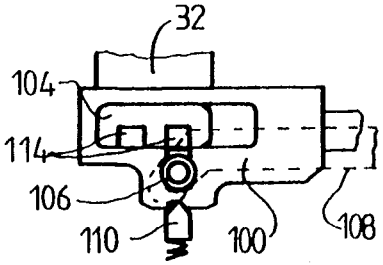
FIGS. 13 to 24 are plan views showing how the feed means operates, FIGS. 14, 16, 18, 20, 22, and 24 being on a larger scale and showing a detail of the feed means shown in FIGS. 13, 15, 17, 19, 21, and 23.

In the position shown in FIGS. 13 and 14, the latch 106 is not engaged in a groove 114 of the lateral tab of the carriage 32, so the carriage can move forwards through a short distance without entraining the latch support 100, thereby taking up the clearances that are necessary for operation (clearance between the front end of the carriage 32 and the rear end of the round 88, between the front end of the round 88 and the rear end of the chamber 20, and between the front end of the chamber 20 and the retaining carriage 86).

Figure 16:
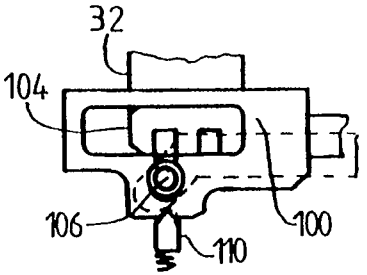
Figure 15:
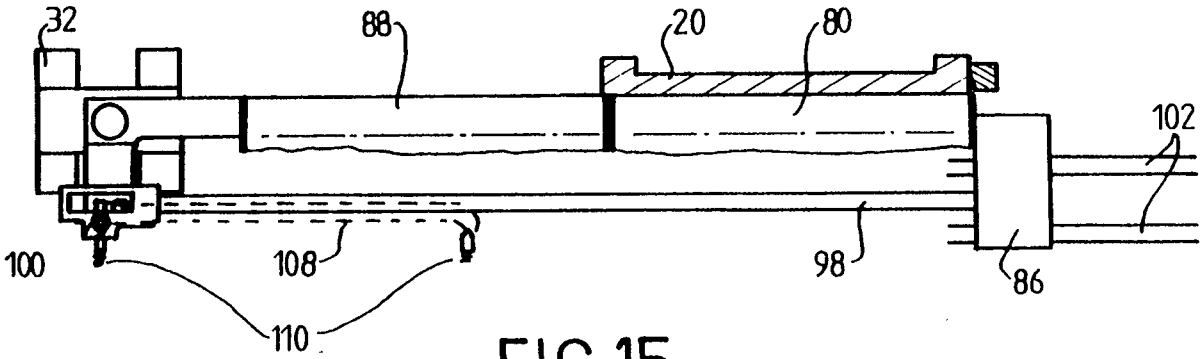
Figure 18:
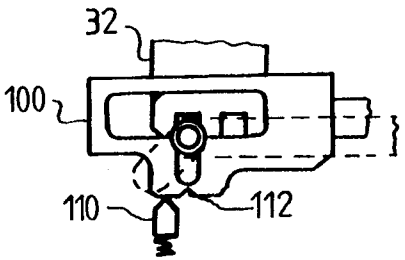
Figure 20:
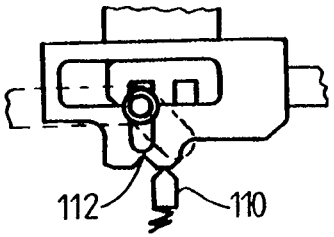
Figure 17:
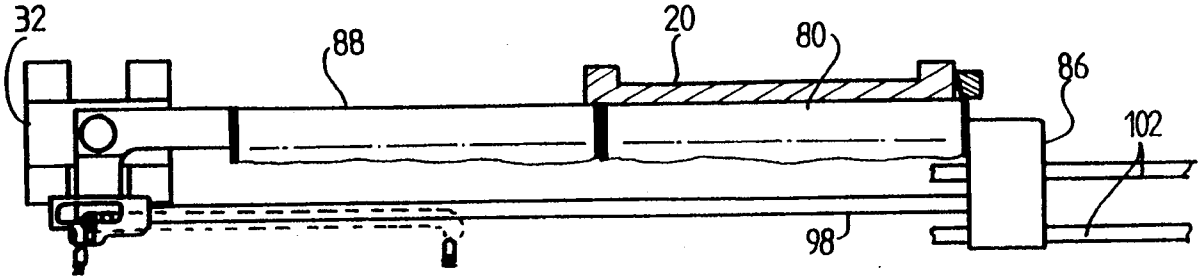
Figure 19:
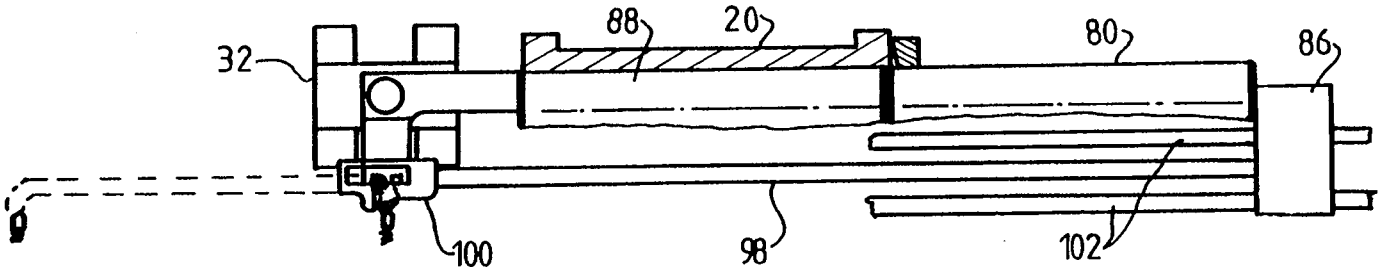

During this small forwards displacement of the carriage 32 (FIGS. 15 and 16) the latch support 100 is held stationary by a peg 110 which is engaged in the notch 112 of said support.

As soon as the clearances have been taken up and the lateral tab 104 of the carriage 32 bears against the front end of the slot in the latch support, the latch 106 as guided by the groove 108 engages in a groove 114 of the tab 104 and secures the carriage 32 to the latch support 100. The latch support is then entrained forwards by the carriage 32 and it disengages from the peg 110, compressing the spring loading the peg.

The carriage 32 continues its forwards displacement (FIGS. 17 to 20) to insert the round 88 into the chamber 20, said round 88 pushing out the empty case 80 from the chamber to engage it on the rectilinear groove 74 of the sleeve support 12 (FIG. 8) where it is likewise supported by the top end of the ejector arm 76 (FIG. 10). During this extraction movement, the front end of the empty case 80 bears against the retaining carriage 86 which is itself moved forwards on the rods 102.

Figure 21:
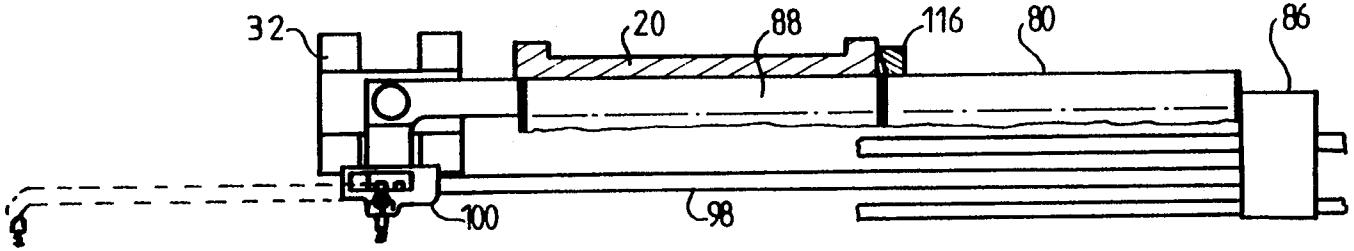

At the end of the stroke (FIGS. 21 and 22) the front end of the carriage 32 penetrates a small distance into the chamber 20, thereby ensuring that the empty case 80 has been fully extracted from the chamber 20 in spite of variations in case length due to manufacturing tolerances, to changes in ambient conditions, and to changes in firing conditions.

Figure 22:
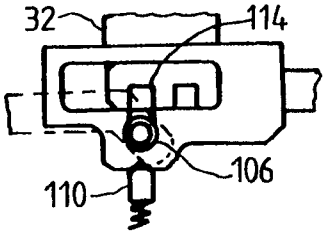

In this extreme forward position, the latch 106 is disengaged from the groove 114 of the lateral tab of the carriage 32, the latch support 100 is held stationary by a peg 110, and the carriage 32 is disunited from the latch support (FIG. 22).

Figure 24:
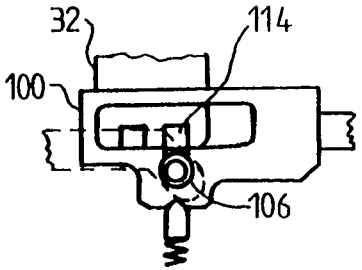
Figure 23:
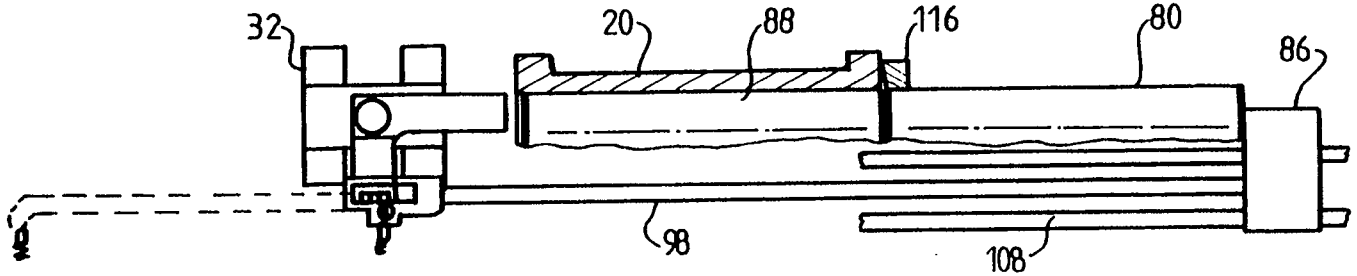

The carriage 32 can then move rearwards over a short distance to disengage from the chamber 20 (FIGS. 23 and 24), without entraining the latch support and thus without displacing the retaining carriage 86 rearwards. At the same time, the empty case 80 is displaced from its extraction position into its ejection position by the ejector arm 76 (FIG. 11), thereby disengaging the passage behind the retaining carriage 86. Simultaneously, the chamber 20 is displaced towards its firing position so as to bring the round 88 into axial alignment with the striker system 42 and with the barrel 10.

During this movement, a calibrating cam 116 situated at the front of the chamber 20 enables the round 88 to be properly repositioned inside the chamber 20. When the chamber 20 is in its firing position, the feed carriage 32 is again secured to the latch support 100 by the latch 106 engaged in a groove 114 of the lateral tab of the carriage 32, so that the carriage 32, the latch support 100, and the retaining carriage 86 can be returned to their rear position of FIGS. 13 and 14.

In general, the gun of the invention operates as follows:

in the ready-to-fire position, the chamber 20 is in its loading position, the carriage 52 for displacing the chamber is in its front position, the feed carriage 32 is in its rear position, a round 88 carried by the feed star 28 is ready to be inserted into the chamber, and a trigger and late fire safety system provided in the rear box 38 prevents any displacement of the parts and thus any movement throughout the gun;

at the beginning of a firing cycle, the electromagnet 44 associated with the rear box 38 releases the trigger and late fire safety system, the electric motor 26 begins to rotate and rotates the shaft 22 and the feed screw 34. The feed carriage 32 inserts a round into the chamber 20, thereby extracting the empty case of the previously-fired round and taking it to the ejection position;

the chamber 20 driven by the carriage 52 moving backwards is brought into the firing position in line with the barrel, the carriage 52 ceases to move the chamber 20, and the round is fired under the control of the rear box 38. The feed carriage 32 begins to move backwards as soon as the chamber 20 is in the immediate vicinity of its firing position;

the late fire safety system is used in the event of the firing system misfunctioning, in the event of the round failing to fire, or in the event of any other incident that prevents the gun from recoiling and thus shows a possible late fire. This safety system makes it possible instantly to block any movement in the rear box and in the gun as a whole, such that the chamber remains in line with the barrel, and a timer interrupts the power supply to the electric motor. Another timer subsequently allows the late fire safety system to be released so as to feed power again to the electric motor, with the gun returning to its ready-to-fire position;

after a round has been fired, the shaft 22 is rotated to return the carriage 52 forwards and to displace the swinging chamber 20 towards its loading position. The feed carriage 32 terminates its backwards motion and the feed star is rotated through a fraction of a revolution to bring a new round into line with the chamber;

if it is then decided that firing should stop, the electromagnet 44 is no longer excited, the late fire safety and trigger system locks the gun in its ready-to-fire position, and the electric motor 26 is no longer powered; otherwise if it is desired to continue firing, the excited electromagnet 44 releases the rear box so that a new round can be loaded into the chamber 20, and so on.

It will be understood that the gun of the invention makes it possible to perform floating firing without waiting for the recoil parts to return to the battery position, i.e. it makes it possible to fire at a very high rate. Under such circumstances, the feed star 20 is itself fed with rounds in conventional manner from a magazine by means that automatically follow the recoil and return to battery position movements of the gun.

We claim:

1. An automatic gun for firing telescoped cylindrical ammunition, the gun comprising a barrel, a breech, a round-receiving chamber disposed between the breech and the barrel, an eccentric pivot shaft parallel with the barrel and mounting said chamber for pivoting movement about the pivot shaft between a loading position and a firing position, means for displacing the chamber between said two positions, means for feeding ammunition to the chamber, electric motor means for driving the chamber displacing means and the ammunition feed means, and a rigid structure that carries the breech, the barrel, the pivot shaft, the ammunition feed means and the electric motor means in a stationary manner, the chamber displacing means comprising means driven by the electric motor means for rotating the pivot shaft about its own axis and transmission means connecting the pivot shaft to the chamber for transforming the rotation of the pivot shaft into a reciprocating oscillation of the chamber between its loading position and its firing position, the ammunition feed means being disposed behind the chamber and being in axial alignment therewith when the chamber is in its loading position, and comprising means for displacing a round of ammunition in axial translation between a feed position and the chamber while the chamber is in its loading position, insertion of a round via a rear end of the chamber causing an empty case of a previously fired round to be extracted via a front end of said chamber.

2. A gun according to claim 1, said gun being a medium caliber cannon.

3. A gun according to claim 1, wherein the transmission means comprise firstly a carriage guided in translation on said rigid structure parallel to the pivot shaft of the chamber and displaced in rectilinear reciprocating motion by said shaft by means of a wheel carried by the carriage and engaged in a helical groove on the shaft, and secondly a wheel secured to the chamber and engaged in a sloping groove of said carriage.

4. A gun according to claim 3, wherein the chamber is carried at its axial ends by two parallel arms mounted to rotate on the pivot shaft, said carriage being disposed between the chamber and the shaft.

5. A gun according to claim 1, wherein the chamber includes circular collars at each of its axial ends and designed to engage, when the chamber is brought into its firing position, into corresponding grooves in the breech and in a sleeve for supporting the barrel.

6. A gun according to claim 5, wherein the sleeve that supports the barrel includes a longitudinal groove formed over a portion of its length from its rear end for the purpose of receiving an empty case extracted from the chamber when in its loading position.

7. A gun according to claim 6, wherein a case ejector arm is mounted to pivot about a longitudinal axis on said rigid structure, a top end of the arm being designed to bear against an empty case extracted from the chamber, the bottom end of an arm being linked to a chamber support arm so that an empty case extracted from the chamber is displaced towards an ejection position by the top end of the ejector arm when the chamber is displaced from its loading position towards its firing position.

8. A gun according to claim 6, wherein the axial displacement of an empty case extracted from the chamber is limited by a retaining carriage guided in translation on said rigid structure and forming a support abutment for a front end of the empty case, said retaining carriage being driven in rectilinear reciprocating motion by the means ammunition feed.

9. A gun according to claim 8, wherein the ammunition feed means comprise a feed carriage guided in translation on said rigid structure and displaceable in rectilinear reciprocating motion to drive a round from a feed position situated behind the chamber when in its loading position and to insert the round in the chamber by axial translation, said carriage including a wheel engaged in a helical groove of a longitudinal screw rotated by said electric motor means, and wherein the feed carriage is connected to the retaining carriage by a rigid rod and by means for taking up operating clearances.

10. A gun according to claim 1, wherein the ammunition feed means comprise a feed carriage guided in translation on said rigid structure and displaceable in rectilinear reciprocating motion to drive a round from a feed position situated behind the chamber when in its loading position and to insert the round in the chamber by axial translation, said carriage including a wheel engaged in a helical groove of a longitudinal screw rotated by said electric motor means.

11. A gun according to claim 1, wherein the means ammunition feed also comprise a feed star carrying a certain number of rounds and mounted to rotate about a longitudinal axis on said rigid structure, behind the chamber so as to bring rounds successively into position on the axis of the chamber when the chamber is in its loading position.

12. A gun according to claim 1, wherein the angular displacement of the chamber between its loading position and its firing position is of the order of 30°.

13. A gun according to claim 1, wherein the rigid structure is a recoiling structure and the chamber displacing means and the ammunition feed means carried by the rigid structure are adapted for enabling a floating fire by firing a round before the said rigid structure has returned to a battery position.

* * * * *

UNITED STATES PATENT AND TRADEMARK OFFICE

CERTIFICATE OF CORRECTION

PATENT NO. : 5,353,678

DATED : October 11, 1994

INVENTOR(S) : Marc Rochelle et al.

It is certified that error appears in the above-identified patent and that said Letters Patent is hereby corrected as shown below:

Column 10, line 11, "means ammunition feed" should be -- ammunition feed means --.

Column 10, lines 34 and 35, "means ammunition feed" should be -- ammunition feed means --.

Signed and Sealed this

Twenty-ninth Day of November, 1994

*Attest:*

Bruce Lehman

BRUCE LEHMAN

*Attesting Officer*

*Commissioner of Patents and Trademarks*